US010839738B2

(12) United States Patent
Lin et al.

(10) Patent No.: US 10,839,738 B2
(45) Date of Patent: Nov. 17, 2020

(54) INTERLACED OR INTERLEAVED VARIABLE PERSISTENCE DISPLAYS

(71) Applicant: Apple Inc., Cupertino, CA (US)

(72) Inventors: Hung Sheng Lin, San Jose, CA (US); Paolo Sacchetto, Cupertino, CA (US); Yingying Tang, Sunnyvale, CA (US); Hyunwoo Nho, Stanford, CA (US); Sebastian Knitter, San Francisco, CA (US); Chaohao Wang, Sunnyvale, CA (US); Sheng Zhang, Milpitas, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/944,470

(22) Filed: Apr. 3, 2018

(65) Prior Publication Data

US 2019/0180669 A1 Jun. 13, 2019

Related U.S. Application Data

(60) Provisional application No. 62/562,864, filed on Sep. 25, 2017.

(51) Int. Cl.
*G09G 3/3225* (2016.01)
*G09G 3/20* (2006.01)
(Continued)

(52) U.S. Cl.
CPC ..... *G09G 3/2025* (2013.01); *G09G 3/2074* (2013.01); *G09G 3/2081* (2013.01);
(Continued)

(58) Field of Classification Search
CPC ..... G09G 3/2074
See application file for complete search history.

(56) References Cited

U.S. PATENT DOCUMENTS 7,612,757 B2 11/2009 Feng et al.
9,123,284 B2 9/2015 Yoshida
(Continued)

FOREIGN PATENT DOCUMENTS

JP 2006154751 A 6/2006
KR 20070067815 A 6/2007
WO 2016156802 A1 10/2016

OTHER PUBLICATIONS

International Search Report and Written Opinion for PCT Application No. PCT/US2018/051832 dated Oct. 17, 2018; 24 pgs.

*Primary Examiner* — Abdul-Samad A Adediran
(74) *Attorney, Agent, or Firm* — Fletcher Yoder, P.C.

(57) ABSTRACT

An electronic device that includes processing circuitry configured to generate a frame of image data that has a frame duration is provided. The electronic device includes a display that has a plurality of pixels. Each of the plurality of pixels displays image data from the frame of image data for a pixel emission period that is less than the frame duration. A first pixel of a column of pixels of the plurality of pixels begins displaying the image data from the frame of image data at a first time for a first duration. A second pixel of the column of pixels that is adjacent to the first pixel begins displaying the image data from the frame of image data at a second time for a second duration. The first and second durations are equal to the pixel emission period. The second time begins after the first duration of time.

20 Claims, 15 Drawing Sheets

(51) Int. Cl.
*G09G 3/34* (2006.01)
*G09G 3/36* (2006.01)

(52) U.S. Cl.
CPC ..... *G09G 3/3413* (2013.01); *G09G 3/3426* (2013.01); *G09G 3/3648* (2013.01); *G09G 2300/0443* (2013.01); *G09G 2310/061* (2013.01); *G09G 2320/0247* (2013.01); *G09G 2320/0261* (2013.01)

(56) References Cited

U.S. PATENT DOCUMENTS

| | | | | |
|---|---|---|---|---|
| 2006/0279478 | A1 | 12/2006 | Ikegami | |
| 2009/0278777 | A1 | 11/2009 | Wang et al. | |
| 2013/0069854 | A1 | 3/2013 | Park et al. | |
| 2015/0310797 | A1 | 10/2015 | Pollok | |
| 2017/0200412 | A1 | 7/2017 | Gu et al. | |
| 2019/0043421 | A1* | 2/2019 | Yang ..... | G09G 3/2074 |

* cited by examiner

INTERLACED OR INTERLEAVED VARIABLE PERSISTENCE DISPLAYS

CROSS-REFERENCE TO RELATED APPLICATIONS

This application is a Non-Provisional patent Application of U.S. Provisional Patent Application No. 62/562,864, entitled "INTERLACED OR INTERLEAVED VARIABLE PERSISTENCE DISPLAYS", filed Sep. 25, 2017, which is herein incorporated by reference in its entirety and for all purposes.

BACKGROUND

The present disclosure relates generally to electronic displays. More specifically, the present disclosure relates to systems and methods for achieving a reduction in visual artifacts of electronic displays.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Numerous electronic devices, such as televisions, portable phones, computers, wearable devices, vehicle dashboards, virtual-reality glasses, and more, include electronic displays. As content is shown on the pixels of the electronic displays, visual artifacts may occur. For example, perceived motion (e.g., a moving object) that appears on the electronic display may look blurry to users of the electronic device.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to systems and methods for reducing visual artifacts of electronic displays. For example, in electronic displays such as liquid crystal displays (LCDs), light-emitting diode (LED) displays, and other types of displays, visual artifacts may occur due to perceived motion of content displayed on the electronic displays. Visual artifacts that remain on a display may be referred to as image retention, image persistence, sticking artifacts, and/or ghost images. These visual artifacts may cause an image to appear to remain on a display for a period of time after the image content is no longer being provided by the electronic display.

Accordingly, to reduce and/or eliminate these visual artifacts, in some embodiments, a portion of pixels of a display may be rendered at one time, while at least one other portion of pixels of the display are rendered at a second time that occurs before the pixels of the display are refreshed with a new frame of image data. For example, as described below, the pixels of the display may be utilized in an interlaced or interleaved manner. Additionally, the pixels of the display may have a persistence that is less than the amount of time associated with the refresh rate of the display. For example, a frame display time of approximately 16.6 milliseconds is associated with a refresh rate of 60 hertz. In such an example, the pixels may have a persistence that is less than 16.6 milliseconds (e.g., approximately 8.3 or 4.17 milliseconds) using techniques that include interlacing or interleaving the programming of the image data on the pixels of the electronic display. By reducing the persistence of the pixels and rendering different portions of the pixels during the time associated with the refresh rate, certain visual artifacts related to image persistence may be reduced and/or eliminated.

Various refinements of the features noted above may be made in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
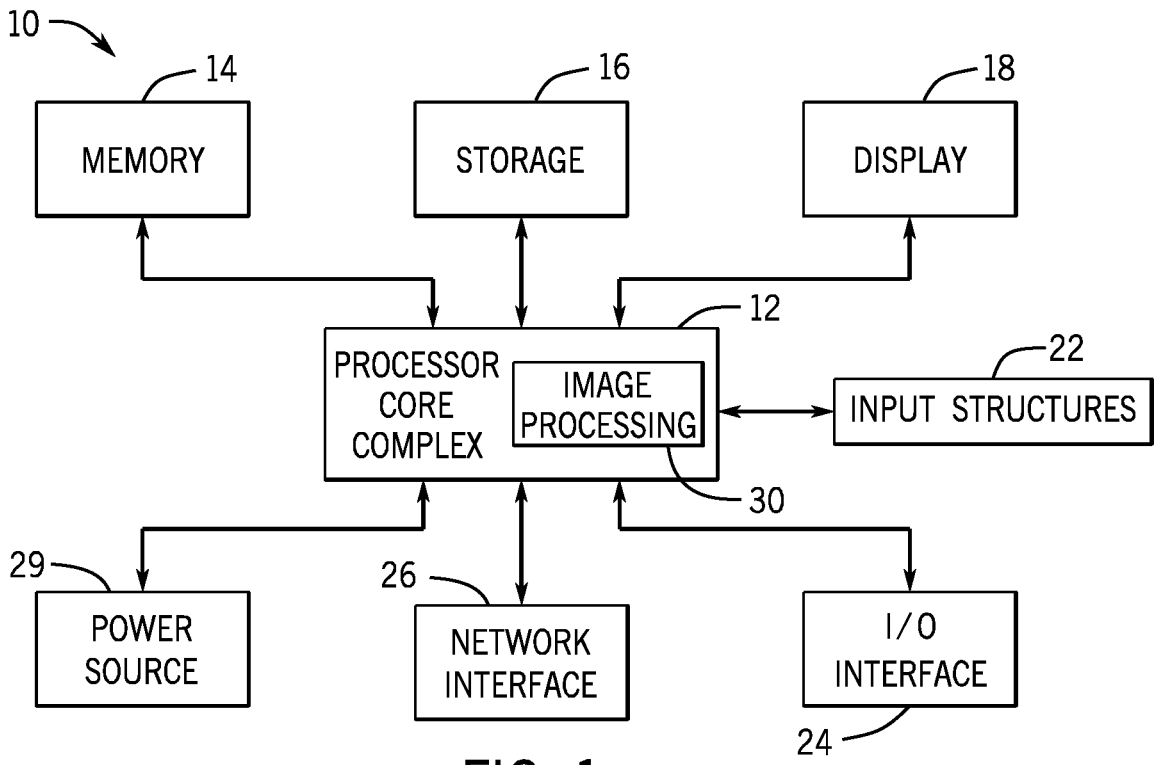
FIG. 1 is a block diagram of an electronic device with an electronic display, in accordance with an embodiment.
Figure 2:
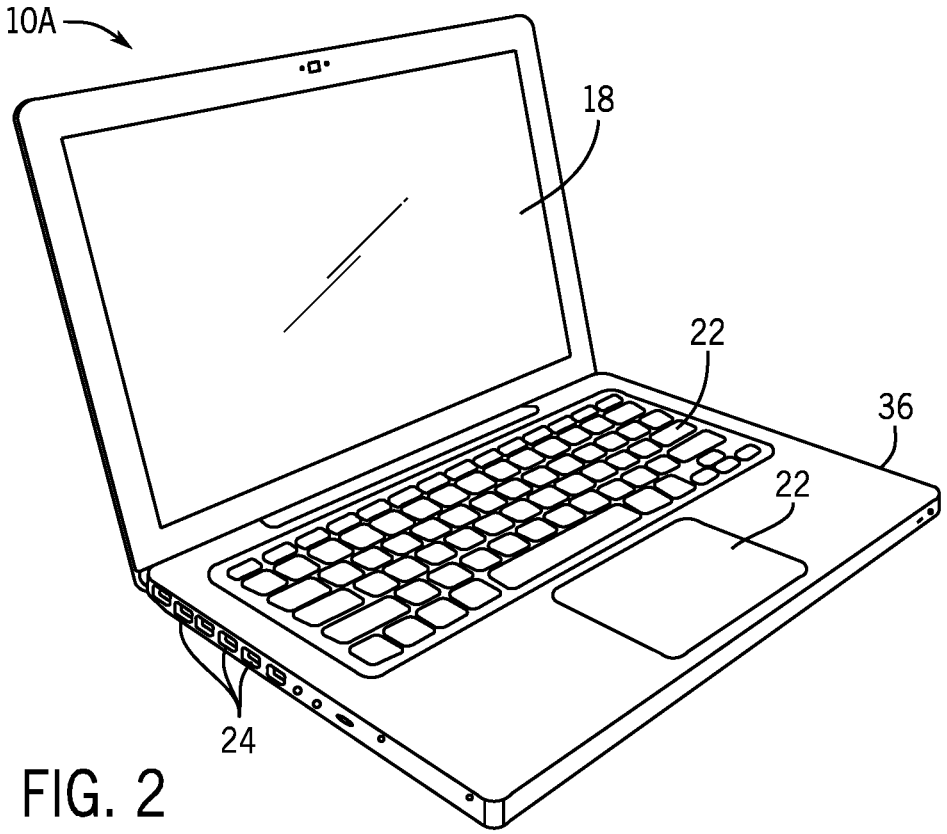
FIG. 2 is a perspective view of a notebook computer representing an embodiment of the electronic device of FIG. 1.
Figure 4:
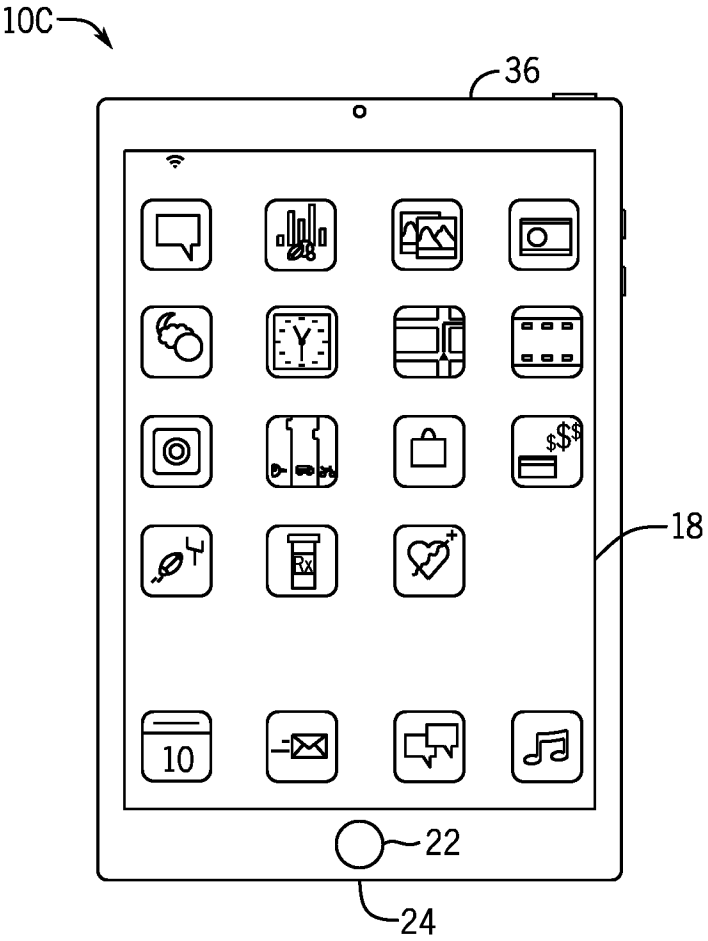
FIG. 4 is a front view of another hand-held device representing another embodiment of the electronic device of FIG. 1.
Figure 3:
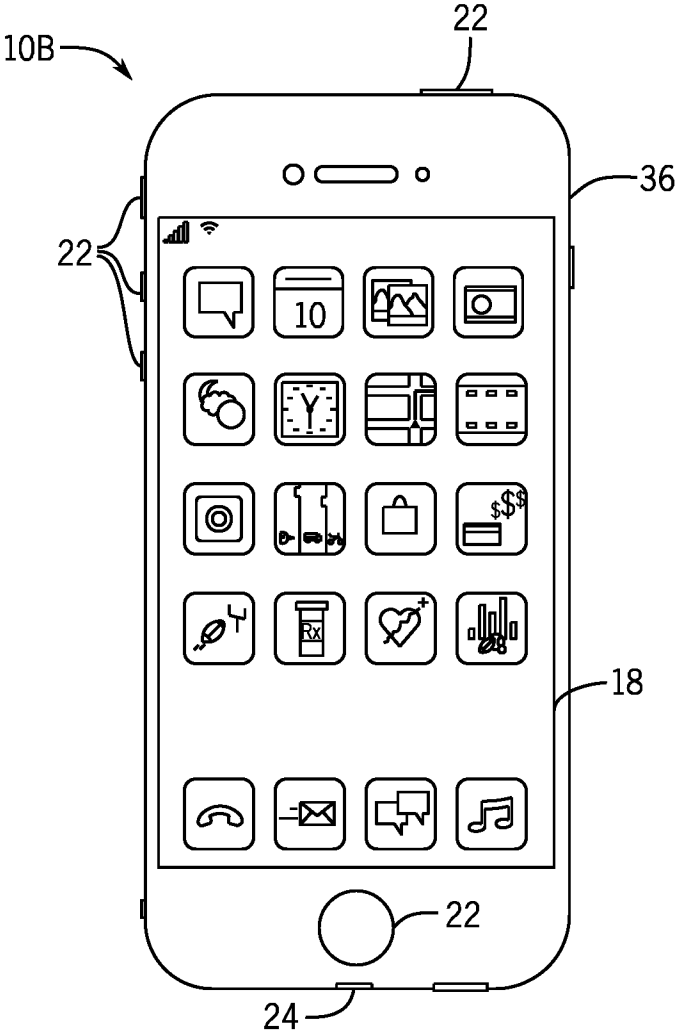
FIG. 3 is a front view of a hand-held device representing another embodiment of the electronic device of FIG. 1.
Figure 5:
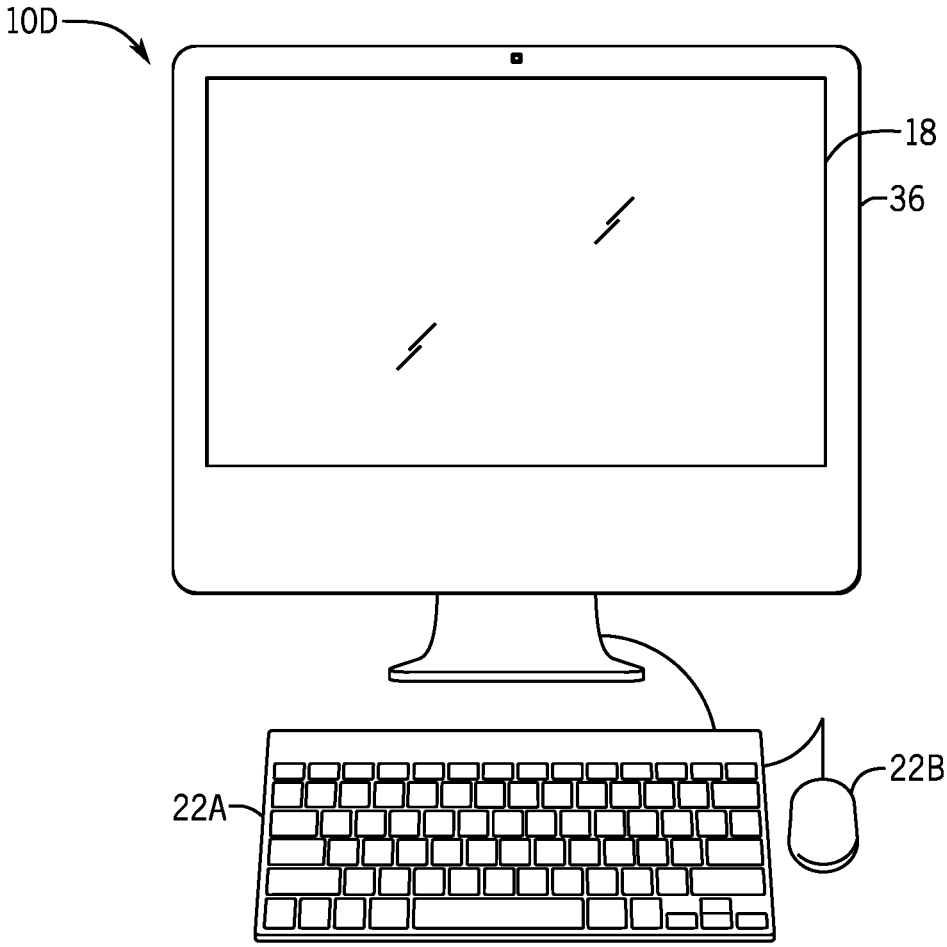
FIG. 5 is a front view of a desktop computer representing another embodiment of the electronic device of FIG. 1.
Figure 6:
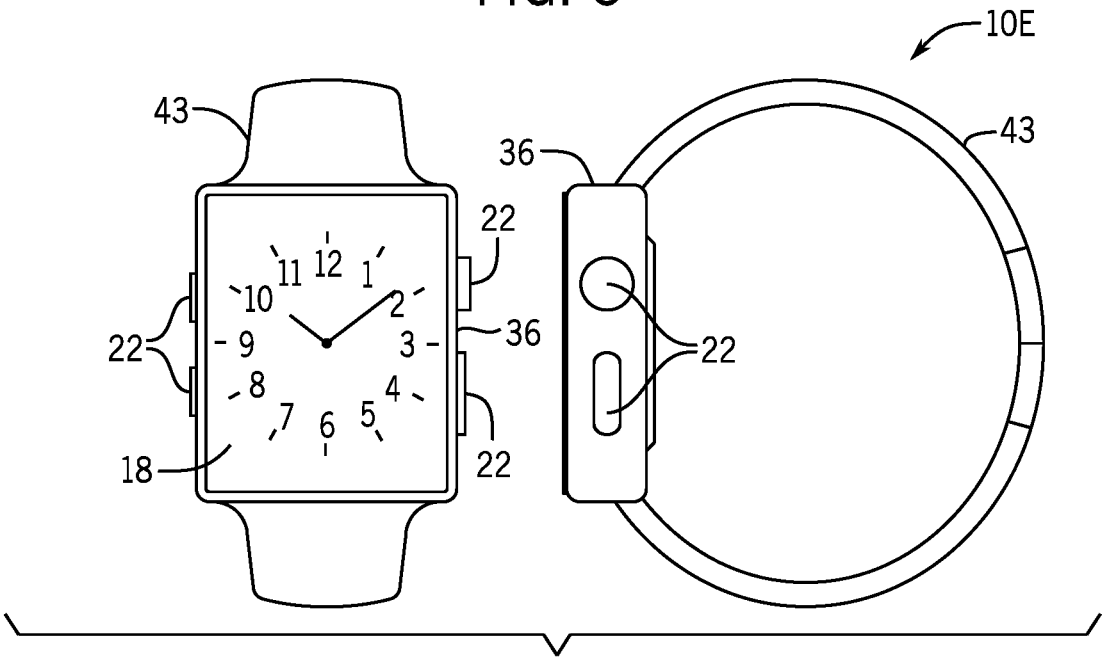
FIG. 6 is a front view and side view of a wearable electronic device representing another embodiment of the electronic device of FIG. 1.

With this in mind, a block diagram of an electronic device 10 is shown in FIG. 1 that may mitigate visual artifacts. As will be described in more detail below, the electronic device 10 may represent any suitable electronic device, such as a computer, a mobile phone, a portable media device, a tablet, a television, a virtual-reality headset, a vehicle dashboard, or the like. The electronic device 10 may represent, for example, a notebook computer 10A as depicted in FIG. 2, a handheld device 10B as depicted in FIG. 3, a handheld device 10C as depicted in FIG. 4, a desktop computer 10D as depicted in FIG. 5, a wearable electronic device 10E as depicted in FIG. 6, or any suitable similar device.

The electronic device 10 shown in FIG. 1 may include, for example, a processor core complex 12, a local memory 14, a main memory storage device 16, an electronic display 18, input structures 22, an input/output (I/O) interface 24, network interfaces 26, and a power source 29. Moreover, image processing 30 may prepare image data from the processor core complex 12 for display on the electronic display 18. Although the image processing 30 is shown as a component within the processor core complex 12, the image processing 30 may represent any suitable hardware or software that may occur between the initial creation of the image data and its preparation for display on the electronic display 18. Thus, the image processing 30 may be located wholly or partly in the processor core complex 12, wholly or partly as a separate component between the processor core complex 12, or wholly or partly as a component of the electronic display 18.

The various functional blocks shown in FIG. 1 may include hardware elements (including circuitry), software elements (including machine-executable instructions stored on a tangible, non-transitory medium, such as the local memory 14 or the main memory storage device 16) or a combination of both hardware and software elements. It should be noted that FIG. 1 is merely one example of a particular implementation and is intended to illustrate the types of components that may be present in electronic device 10. Indeed, the various depicted components may be combined into fewer components or separated into additional components. For example, the local memory 14 and the main memory storage device 16 may be included in a single component.

The processor core complex 12 may carry out a variety of operations of the electronic device 10, such as generating image data to be displayed on the electronic display 18. The processor core complex 12 may include any suitable data processing circuitry to perform these operations, such as one or more microprocessors, one or more application specific processors (ASICs), or one or more programmable logic devices (PLDs). In some cases, the processor core complex 12 may execute programs or instructions (e.g., an operating system or application program) stored on a suitable article of manufacture, such as the local memory 14 and/or the main memory storage device 16. In addition to instructions for the processor core complex 12, the local memory 14 and/or the main memory storage device 16 may also store data to be processed by the processor core complex 12. By way of example, the local memory 14 may include random access memory (RAM) and the main memory storage device 16 may include read only memory (ROM), rewritable non-volatile memory such as flash memory, hard drives, optical discs, or the like.

The electronic display 18 may display image frames, such as a graphical user interface (GUI) for an operating system or an application interface, still images, or video content. The processor core complex 12 may supply at least some of the image frames. The electronic display 18 may be a self-emissive display, such as an organic light emitting diode (OLED) display, an LED, or μLED display, or may be a liquid crystal display (LCD) illuminated by a backlight. In some embodiments, the electronic display 18 may include a touch screen, which may allow users to interact with a user interface of the electronic device 10. The electronic display 18 may employ display panel sensing to identify operational variations of the electronic display 18. This may allow the processor core complex 12 to adjust image data that is sent to the electronic display 18 to compensate for these variations, thereby improving the quality of the image frames appearing on the electronic display 18.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interface 26. The network interface 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a cellular network. The network interface 26 may also include interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra wideband (UWB), alternating current (AC) power lines, and so forth. The power source 29 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 10A, is illustrated in FIG. 2 in accordance with one embodiment of the present disclosure. The depicted computer 10A may include a housing or enclosure 36, an electronic display 18, input structures 22, and ports of an I/O interface 24. In one embodiment, the input structures 22 (such as a keyboard and/or touchpad) may be used to interact with the computer 10A, such as to start, control, or operate a GUI or applications running on computer 10A. For example, a keyboard and/or touchpad may allow a user to navigate a user interface or application interface displayed on the electronic display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. of Cupertino, Calif. The handheld device 10B may include an enclosure 36 to protect interior components from physical damage and to shield them from electromagnetic interference. The enclosure 36 may surround the electronic display 18. The I/O interfaces 24 may open through the enclosure 36 and may include, for example, an I/O port for a hardwired connection for charging and/or content manipulation using a standard connector and protocol, such as the Lightning connector provided by Apple Inc., a universal service bus (USB), or other similar connector and protocol.

User input structures 22, in combination with the electronic display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 10C, which represents another embodiment of the electronic device 10. The handheld device 10C may represent, for example, a tablet computer or portable computing device. By way of example, the handheld device 10C may be a tablet-sized embodiment of the electronic device 10, which may be, for example, a model of an iPad® available from Apple Inc. of Cupertino, Calif.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the electronic display 18. In certain embodiments, a user of the computer 10D may interact with the computer 10D using various peripheral input devices, such as input structures 22A or 22B (e.g., keyboard and mouse), which may connect to the computer 10D.

Similarly, FIG. 6 depicts a wearable electronic device 10E representing another embodiment of the electronic device 10 of FIG. 1 that may be configured to operate using the techniques described herein. By way of example, the wearable electronic device 10E, which may include a wristband 43, may be an Apple Watch® by Apple, Inc. However, in other embodiments, the wearable electronic device 10E may include any wearable electronic device such as, for example, a wearable exercise monitoring device (e.g., pedometer, accelerometer, heart rate monitor), or other device by another manufacturer. The electronic display 18 of the wearable electronic device 10E may include a touch screen display 18 (e.g., LCD, OLED display, active-matrix organic light emitting diode (AMOLED) display, and so forth), as well as input structures 22, which may allow users to interact with a user interface of the wearable electronic device 10E.

Figure 7:
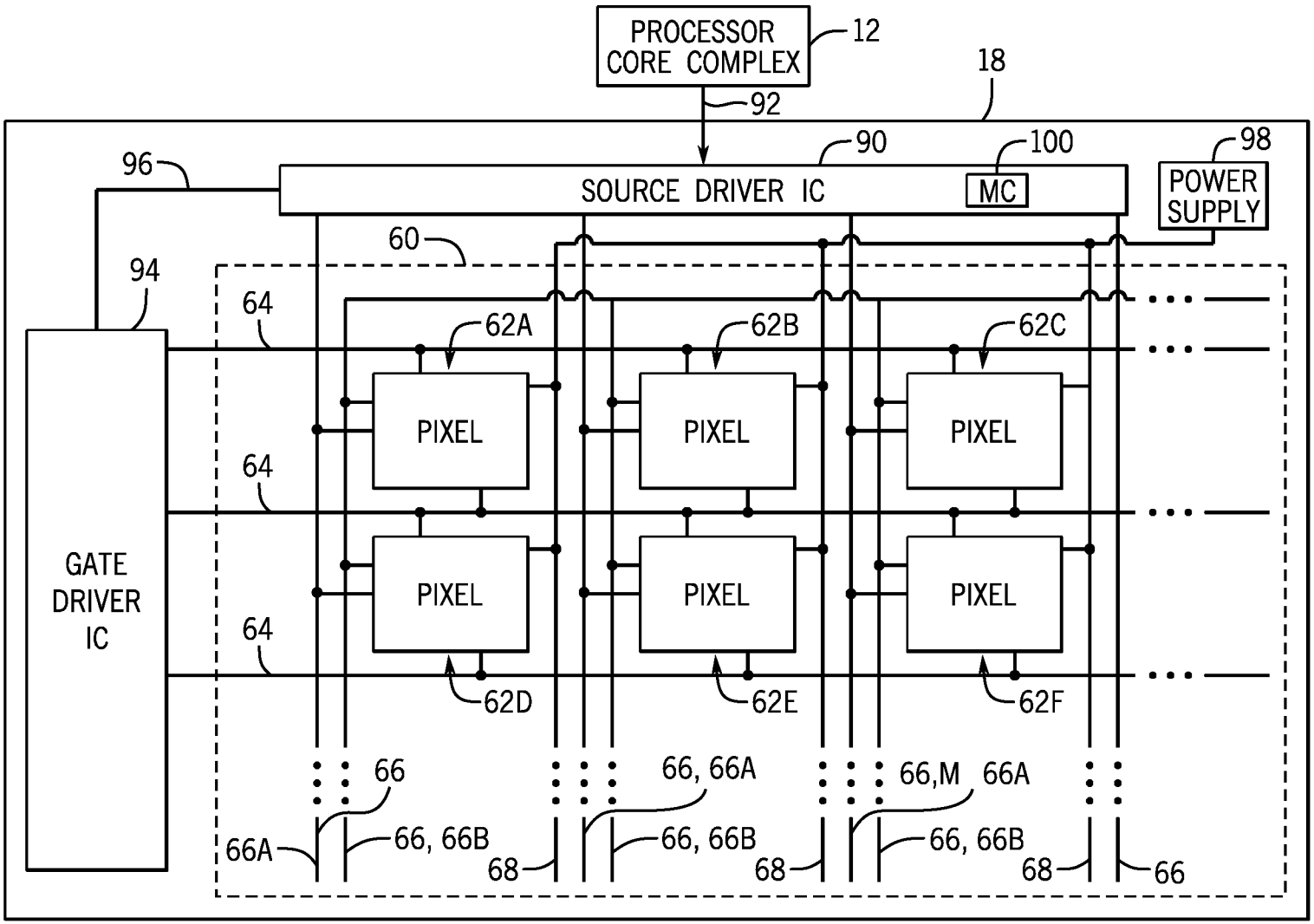
FIG. 7 is a circuit diagram illustrating a portion of an array of pixels of the display of FIG. 1, in accordance with an embodiment.

The electronic display 18 for the electronic device 10 may include a matrix of pixels that contain light-emitting circuitry. Accordingly, FIG. 7 illustrates a circuit diagram including a portion of a matrix of pixels in an active area of the electronic display 18. As illustrated, the electronic display 18 may include a display panel 60. Moreover, the display panel 60 may include multiple unit pixels 62 (here, six unit pixels 62A, 62B, 62C, 62D, 62E, and 62F are shown) arranged as an array or matrix defining multiple rows and columns of the unit pixels 62 that collectively form a viewable region of the electronic display 18, in which an image may be displayed. In such an array, each unit pixel 62 may be defined by the intersection of rows and columns, represented here by the illustrated gate lines 64 (also referred to as "scanning lines") and data lines 66 (also referred to as "source lines"), respectively. Additionally, power supply lines 68 may provide power to each of the unit pixels 62. The unit pixels 62 may include, for example, a thin film transistor (TFT) coupled to a self-emissive pixel, such as an OLED, whereby the TFT may be a driving TFT that facilitates control of the luminance of a display pixel 62 by controlling a magnitude of supply current flowing into the OLED of the display pixel 62 or a TFT that controls luminance of a display pixel by controlling the operation of a liquid crystal.

Although only six unit pixels 62, referred to individually by reference numbers 62*a*-62*f*, respectively, are shown, it should be understood that in an actual implementation, each data line 66 and gate line 64 may include hundreds or even thousands of such unit pixels 62. By way of example, in a color display panel 60 having a display resolution of 1024×768, each data line 66, which may define a column of the pixel array, may include 768 unit pixels, while each gate line 64, which may define a row of the pixel array, may include 1024 groups of unit pixels with each group including a red, blue, and green pixel, thus totaling 3072 unit pixels per gate line 64. It should be readily understood, however, that each row or column of the pixel array any suitable number of unit pixels, which could include many more pixels than 1024 or 768. In the presently illustrated example, the unit pixels 62 may represent a group of pixels having a red pixel (62A), a blue pixel (62B), and a green pixel (62C). The group of unit pixels 62D, 62E, and 62F may be arranged in a similar manner. Additionally, in the industry, it is also common for the term "pixel" may refer to a group of adjacent different-colored pixels (e.g., a red pixel, blue pixel, and green pixel), with each of the individual colored pixels in the group being referred to as a "sub-pixel." In some cases, however, the term "pixel" refers generally to each sub-pixel depending on the context of the use of this term.

The electronic display 18 also includes a source driver integrated circuit (IC) 90, which may include a chip, such as a processor or application specific integrated circuit (ASIC), that controls various aspects (e.g., operation) of the electronic display 18 and/or the panel 60. For example, the source driver IC 90 may receive image data 92 from the processor core complex 12 and send corresponding image signals to the unit pixels 62 of the panel 60. The source driver IC 90 may also be coupled to a gate driver IC 94, which may provide/remove gate activation signals to activate/deactivate rows of unit pixels 62 via the gate lines 64. Additionally, the source driver IC 90 may include a timing controller (TCON) that determines and sends timing information/image signals 96 to the gate driver IC 94 to facilitate activation and deactivation of individual rows of unit pixels 62. In other embodiments, timing information may be provided to the gate driver IC 94 in some other manner (e.g., using a controller 100 that is separate from or integrated within the source driver IC 90). Further, while FIG. 7 depicts only a single source driver IC 90, it should be appreciated that other embodiments may utilize multiple source driver ICs 90 to provide timing information/image signals 96 to the unit pixels 62. For example, additional embodiments may include multiple source driver ICs 90 disposed along one or more edges of the panel 60, with each source driver IC 90 being configured to control a subset of the data lines 66 and/or gate lines 64.

Figure 8:
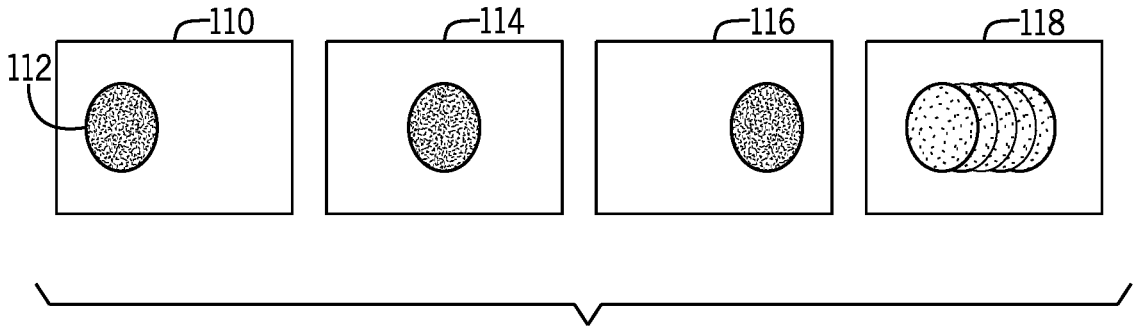
FIG. 8 illustrates motion blur that may be compensated for by interleaving or interlacing programming of pixels of an electronic display of the electronic device, in accordance with an embodiment.

As described above, the source driver IC 90 may send timing information/image signals 96 to cause rows of unit pixels 62 to activate or deactivate. For example, the source driver IC 90 may send signals relating to each frame of content to be displayed via the display 18. In some cases, visual artifacts may occur. For instance, content that is shown on the display 18 may appear blurry to users. FIG. 8 illustrates blurring that may occur due to movement depicted in content shown on the display 18. A first frame 110 of content may include an object 112. The movement of the object 112 may be shown across several other frames. For example, in a second frame 114, a position of the object 112 on the display 18 may differ from the position of the object 112 in the first frame 110. Likewise, the position of the object 112 on the display 18 may differ in the third frame 116, and the motion of the object 112 may be shown by showing the first frame 110, second frame 114, and third frame 116 in succession. For example, if the display was showing the content with a frame rate of 60 frames per second (fps), it would take one-twentieth of a second (i.e., 50 milliseconds) to show three frames of the content. However, as shown in the image 118, the motion of the object 112 may appear blurry to viewers owing to the nature of human visual perception.

While the discussion relating to FIG. 8 pertains to motion blur, visual artifacts may occur for other reasons or as a combination of several factors. For example, response time associated with display 18 may cause visual artifacts. Additionally, motion blur and response time together may cause visual artifacts.

Response time refers to the rate at which content appears on and disappears from the display 18. The appearance of content, which is also known to as latency, can include several factors such as frame rate and the amount of time used to render each frame of the content. The term "frame rate" refers to the rate that frames of image data are displayed in a single second. For instance, in the example above in which the content is shown at a frame rate of 60 fps, 60 frames of the image data content are shown each second. As another example, a frame rate of 120 fps would mean that 120 frames of image data content as shown per second.

The disappearance of content from the display 18 is known as persistence. Persistence occurs when content appears (e.g., to the human eye) to be present on the display 18 after the content is no longer being displayed or would, in reality, not remain in place in a similar scene in the real world. For example, in the image 118, the object 112 appears blurry because the human eye perceives that the object 112 is present in multiple positions on the display 18. Such a phenomenon may occur because pixels of the display 18 are signaled to display the content with certain amounts of persistence. For instance, when the content is shown across an entire row of pixels for the duration of a frame of content, motion depicted on the display may appear blurry at certain frame rates. In other words, when the frame rate and persistence are equal, visual artifacts may occur. As discussed below, visual artifacts may be reduced or altogether eliminated by altering the persistence associated with content to be shown on the display 18.

Figure 9:
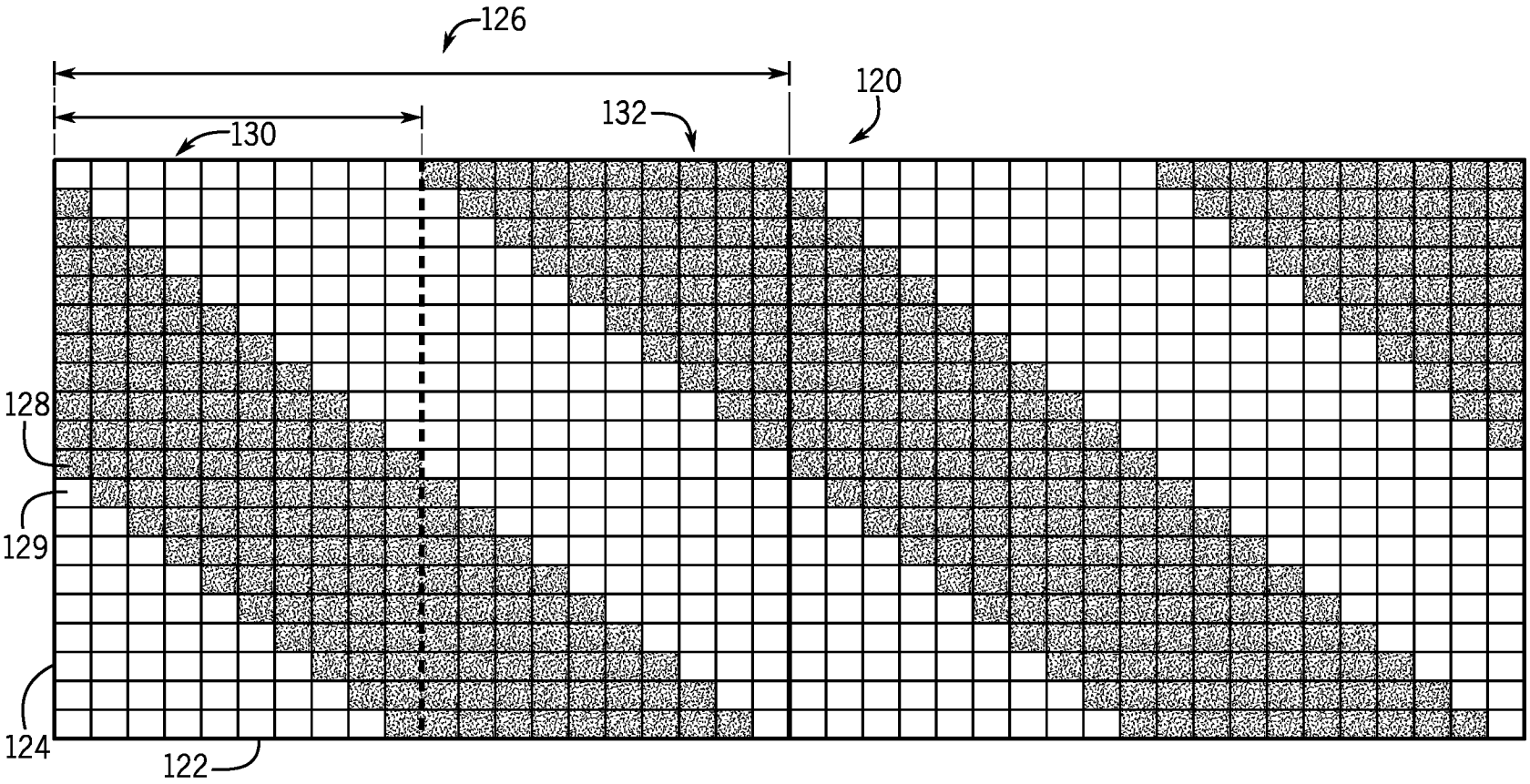
FIG. 9 is a diagram illustrating pixels of an electronic display showing content with a persistence shorter than the frame rate of the content, in accordance with an embodiment.

With the discussion of FIG. 8 in mind, FIG. 9 is a diagram 120 illustrative of pixels of the display 18 over time. More specifically, each square in the diagram 120 represents a pixel, axis 122 is representative of time, and axis 124 is representative of rows of pixels. Darkened pixels (e.g., pixel 128) are representative of a pixel that is not displaying content, while unshaded pixels (e.g., pixel 129) are representative of pixels that are being utilized to display content.

A frame 126 of content is also illustrated in FIG. 9. More specifically, the frame rate associated with the content is 60 fps. Similarly, in the illustrated embodiment, the display 18 has a refresh rate of 60 hertz. However, it should be noted that the discussion associated with FIG. 9 is pertinent to frame rates and refresh rates higher and lower and 60 hertz. Additionally, the persistence associated with the frame 126 of content has a duration that is less than the frame rate. For example, as illustrated, each frame has a duration of approximately 16.6 milliseconds, but the pixels of each row of pixels only display the content for half that amount of time, or approximately 8.3 milliseconds. By reducing the persistence, content will be shown on the display for less time, which may reduce the appearance of visual artifacts visible to viewers. Nevertheless, in the illustrated embodiment, other visual artifacts may still occur. For example, users may perceive flickering between frames of the content. As discussed below, visual artifacts may be more greatly reduced or eliminated by altering both the latency and persistence associated with content.

More specifically, approximately half of the pixels of the frame 126 are rendered during a first phase 130 of the frame 126, and approximately half of the pixels of the frame 126 are rendered during a second phase 132 of the frame 126. In the illustrated embodiment, the second phase 132 occurs at a time equal to approximately half of the refresh rate and/or frame rate. In other words, the source processor core complex 12 may render half of the content associated with the frame 126 at a given time, but the rendering can occur twice as fast compared to times when all of the pixels are rendered simultaneously. That is, the processor core complex 12 may send signals to display content at the start of the frame 126, during a frame, and at the start of a frame subsequent to the frame 126. While portions of the pixels are utilized or not utilized at a given time, in other embodiments, smaller portions of pixels may be utilized. In other words, different distributions of used and unused pixels may be utilized.

Figure 10:
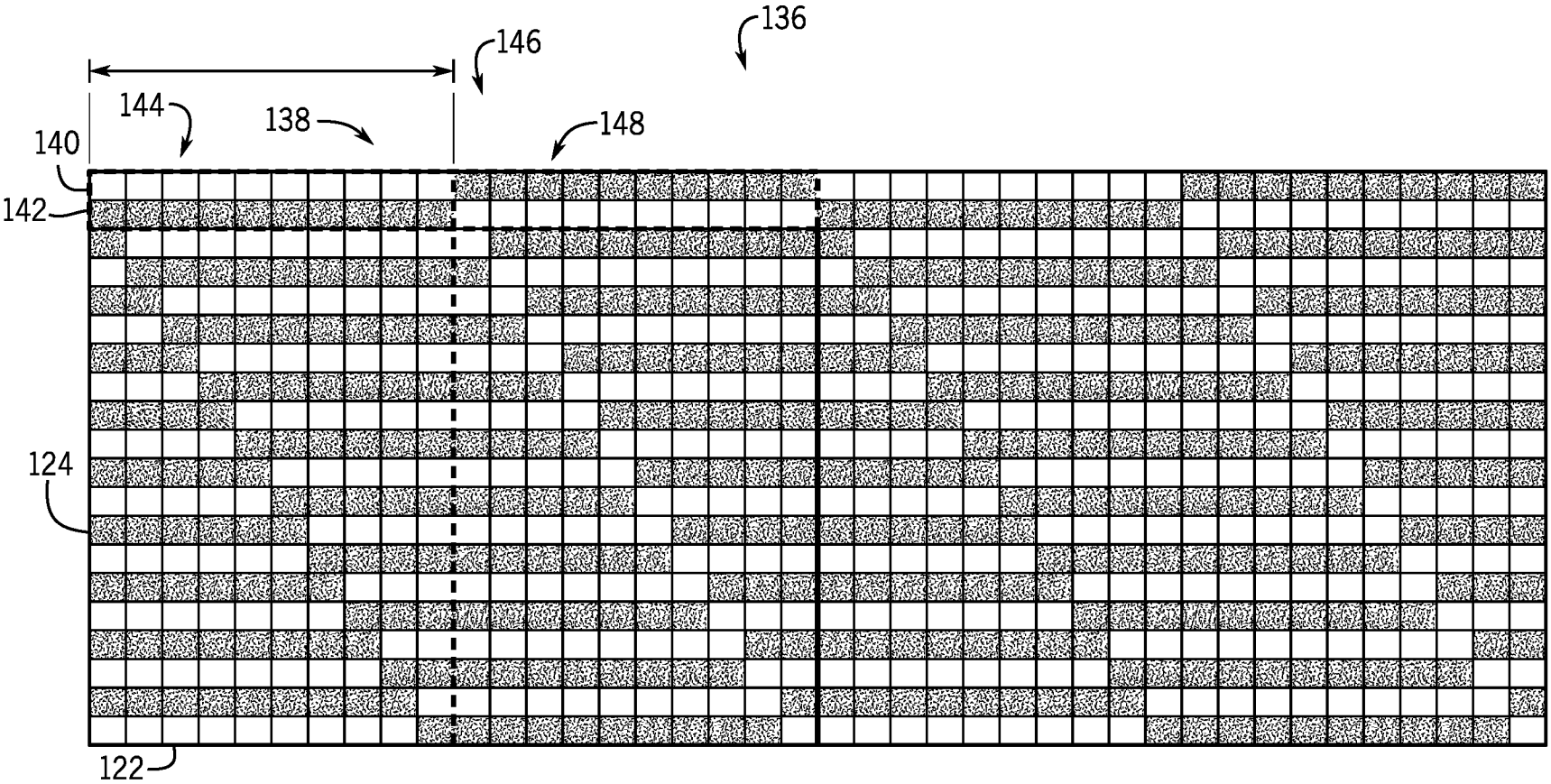
FIG. 10 is a diagram illustrating pixels of an electronic display in which the pixels are programmed in an interlaced manner, in accordance with an embodiment.

For example, FIG. 10 is a diagram 136 of pixels of the display 18 in which the pixels are interlaced. More specifically, the rows of pixels may be categorized into subgroups, and the pixels of a subgroup may emit light at different times from the pixels in the other subgroup. For instance, subgroup 138 may include row 140 and row 142. During a first phase or portion 144 of a frame 146, the pixels of row 140 may be used to display the content being shown on the display 18, while the pixels of row 142 may not be used to display content. During a second portion 148 of the frame 146, pixels of the row 140 may not be used to display content, while pixels of row 142 may be used to show content.

In the illustrated embodiment, the refresh rate of the display 18 is 60 hertz, and the frame rate of the content is 60 fps. Thus, each frame of content will be displayed for approximately 16.6 milliseconds. However, the pixels in a given row (e.g., row 140) will only be utilized for half of the frame (i.e., approximately 8.3 milliseconds). That is, like the embodiment of FIG. 9, the processor core complex 12 may render approximately half of the pixels of the display 18 during the first portion 144 of the frame 146 and render the other pixels of the display 18 during the second portion 148 of the frame 146. However, due to the effect of interlacing, the human eye may perceive a frame rate of 120 fps. Additionally, the interlacing of the pixels reduces visual artifacts and may eliminate the occurrence of visual artifacts altogether. For example, in the example of motion being shown (e.g., motion of the object 112), because the persistence is only half of the refresh rate and frame rate, content for a given row of pixels will not be displayed during the entire frame. Indeed, at a given time, only approximately half of the pixels of the display are being utilized. Because content has a relatively shorter persistence and the pixels are interlaced, motion is perceived to be more fluid to the human eye. That is, content is perceived to have fewer or no visual artifacts. At the same time, the processor core complex 12 renders the pixels of the first portion 144 of at the start of the frame 146, and halfway through the frame 146, the pixels of first portion 144 are no longer utilized while the pixels of the second group 148 are rendered by the source driver IC. As such, the processor core complex 12 may be able to render half the amount of pixels, but twice per frame. As a result of this, the human eye may perceive the motion quality to be a level that is approximately twice the frame rate. For example, displaying content with a frame rate of 60 fps in the described manner may appear to be 120 fps. Moreover, the refresh rate of 60 hertz may be maintained. In other words, the display may appear to the human eye to show content with a frame rate of approximately 120 fps and seem to have a refresh rate of 120 hertz.

While in the present example the persistence is half of the refresh rate, the persistence may vary in other embodiments. For example, as illustrated in diagram 150 of FIG. 11, the persistence is one-fourth of the duration of a frame 152. As a result of the shortened persistence, dimming may occur on the display 18, which may be compensated for with a greater brightness. Still, the frame presentation shown in FIG. 11 may produce some visual artifacts such as flickering. However, the reduction in the amount of time pixels of a given row are utilized may further reduce and/or eliminate the occurrence of visual artifacts typically associated with motion depicted on the display 18. For example, in each of the embodiments discussed herein, a reduction in persistence may increase latency. For instance, because the processor core complex 12 renders approximately half of the pixels at the beginning of a frame and another approximate half of the pixels in the middle of the frame, the processor core complex 12 is less burdened than in cases in which all pixels are rendered at the beginning of a frame. With specific regard to the embodiment of FIG. 11, because the persistence is only about quarter of the duration of the frame, even less pixels are utilized, which allows the processor core complex 12 to be more quickly process content to be displayed on the display 18.

Figure 12:
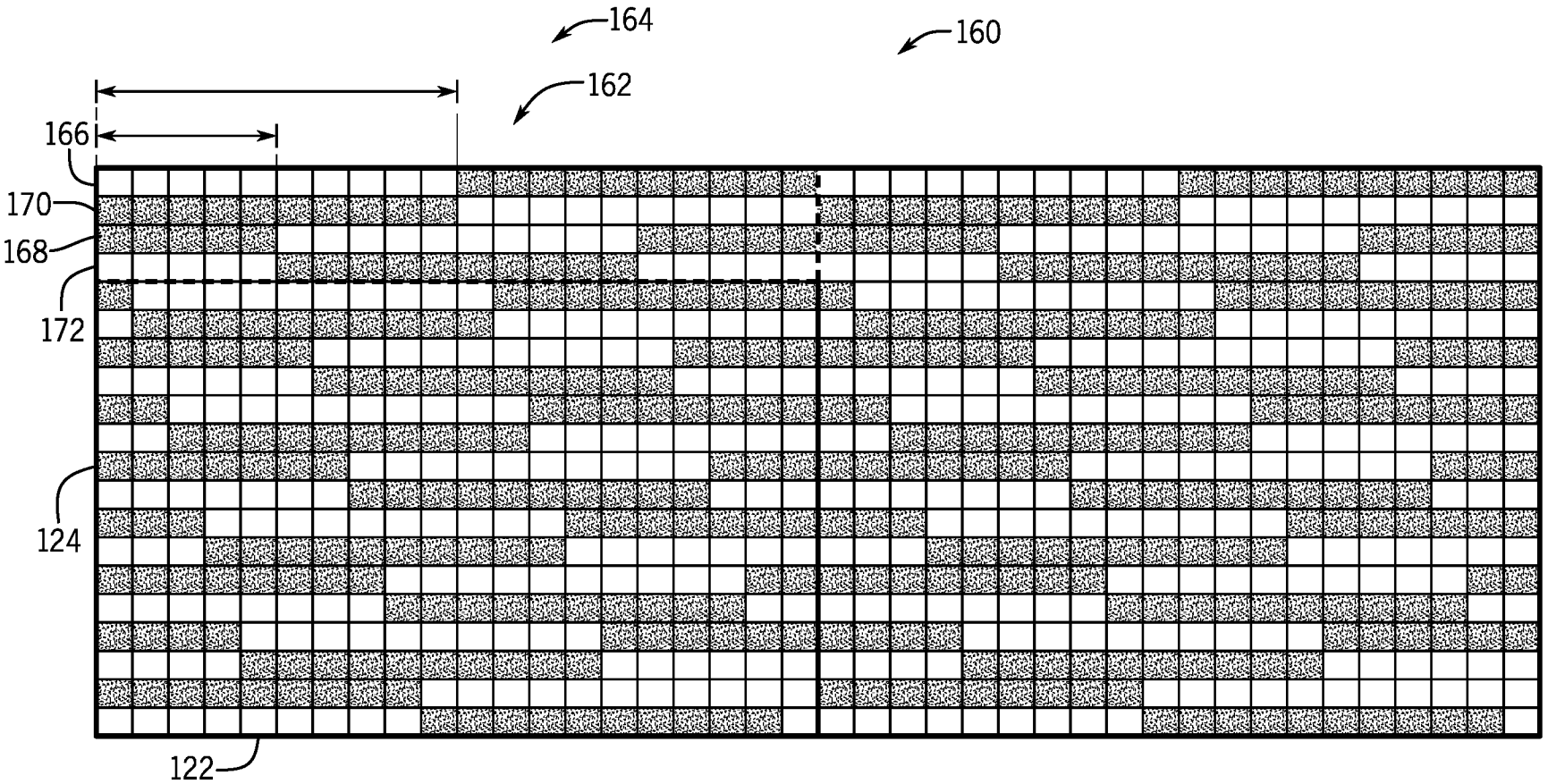
FIG. 12 is yet another diagram illustrating another embodiment in which pixels of the display are programmed in an interlaced manner, in accordance with an embodiment.

Similarly, while subgrouping discussed with regard to FIG. 10 involves subgroups of two rows of pixels, in other embodiments, the subgroups may include more rows. Additionally, the pixels in the subgroups may be driven in patterns that differ from those of the embodiments illustrated in FIG. 10. For instance, FIG. 12 is an illustration of a diagram 160 of the pixels of the display 18 in which a subgroup 162 includes four rows of pixels that each have a persistence that is one half of the duration of each frame. As illustrated, approximately one half of the pixels of the subgroup 162 are illuminated during any given quarter of the duration of a frame 164. More specifically, a first row 166 of pixels are rendered at the beginning of the frame 164, a second row 168 of pixels are rendered at a point in time equal to a quarter of the duration of the frame 164, a third row 170 of pixels are rendered halfway through the frame 164, and a fourth row 172 of pixels is rendered at a point in time equal to three-quarters of the duration of the frame 164. In such an embodiment, the human eye may perceive a frame rate of four times the actual frame rate.

Additionally, in the illustrated embodiment, the pattern of the interlacing is different than the patterns shown in previous embodiments. Interlacing the rows of pixels in the illustrated manner may result in an improved latency. The decrease in persistence and the improved latency may reduce and/or eliminate visual artifacts. For instance, as explained above, because the pixels will be active for shorter amounts of time, the human eye is less likely to see visual artifacts, especially blurring that may occur as motion is depicted on the display 18. Moreover, because the pattern of FIG. 12 has fewer areas in which substantially groups of pixels are all on or are all off at any one time, flickering artifacts may be less likely.

Figure 11:
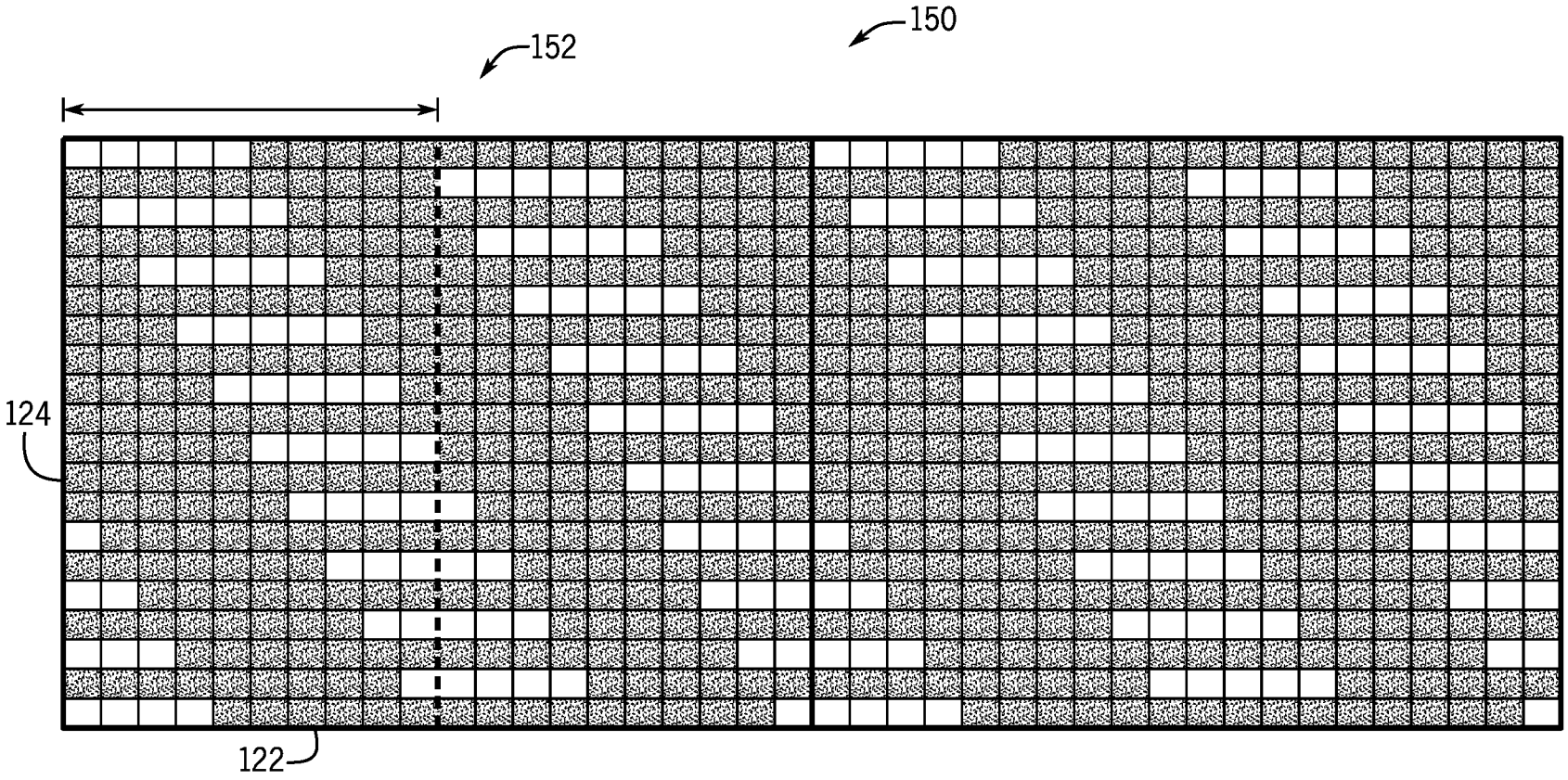
FIG. 11 is another diagram illustrating pixels of an electronic display wherein the pixels are programmed in an interlaced manner, in accordance with an embodiment.
Figure 13:
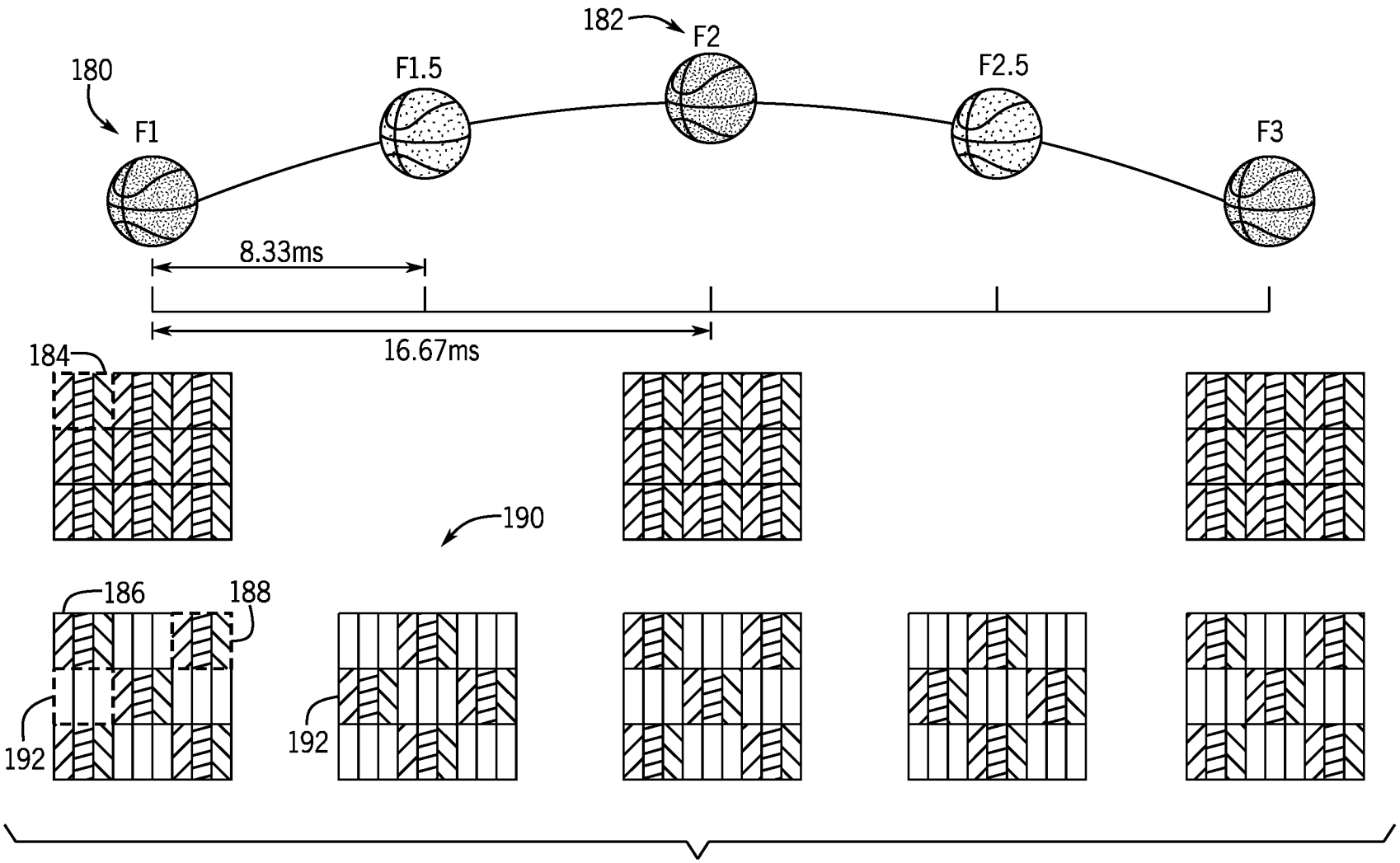
FIG. 13 illustrates frames in which pixels of the display are programmed in an interleaved manner, in accordance with an embodiment.

While FIGS. 10-12 illustrate embodiments in which the pixels of the display 18 are variably interlaced, the pixels of the display 18 may be utilized to achieve a reduction in visual artifacts using interleaving. The interleaving described below may be used separately or in combination with the interlacing above. For instance, FIG. 13 illustrates an embodiment in which the pixels of the display 18 also have a persistence that is shorter than the refresh rate, but are utilized in an interleaved manner. In the example of FIG. 13, every other pixel may be rendered at a given time. More specifically, content to be displayed may include multiple frames (e.g., frames 180, 182), each of which can be shown using pixels, such as pixel 184 of the display 18. However, instead of rendering all of the pixels associated with a particular frame at the beginning of the frame 180, the processor core complex 12 may render a portion of pixels (e.g., pixels 186, 188) at a time corresponding to the beginning of the frame 180 and render another portion of the pixels at time that occurs halfway through the duration of the frame 180. In other words, the processor core complex 12 may render an additional frame (e.g., frame 190) for each frame of content that the processor core complex 12 receives for processing, but render half or less of the pixels of the both of frames. For instance, pixel 192 is not rendered in one frame but is rendered in the frame 190. While the processor core complex 12 is described as being able to render a frame for each received frame with regards to interleaving the pixels of the display 18, it should be noted that additional frames may be rendered in embodiments that include interlacing.

Figure 14:
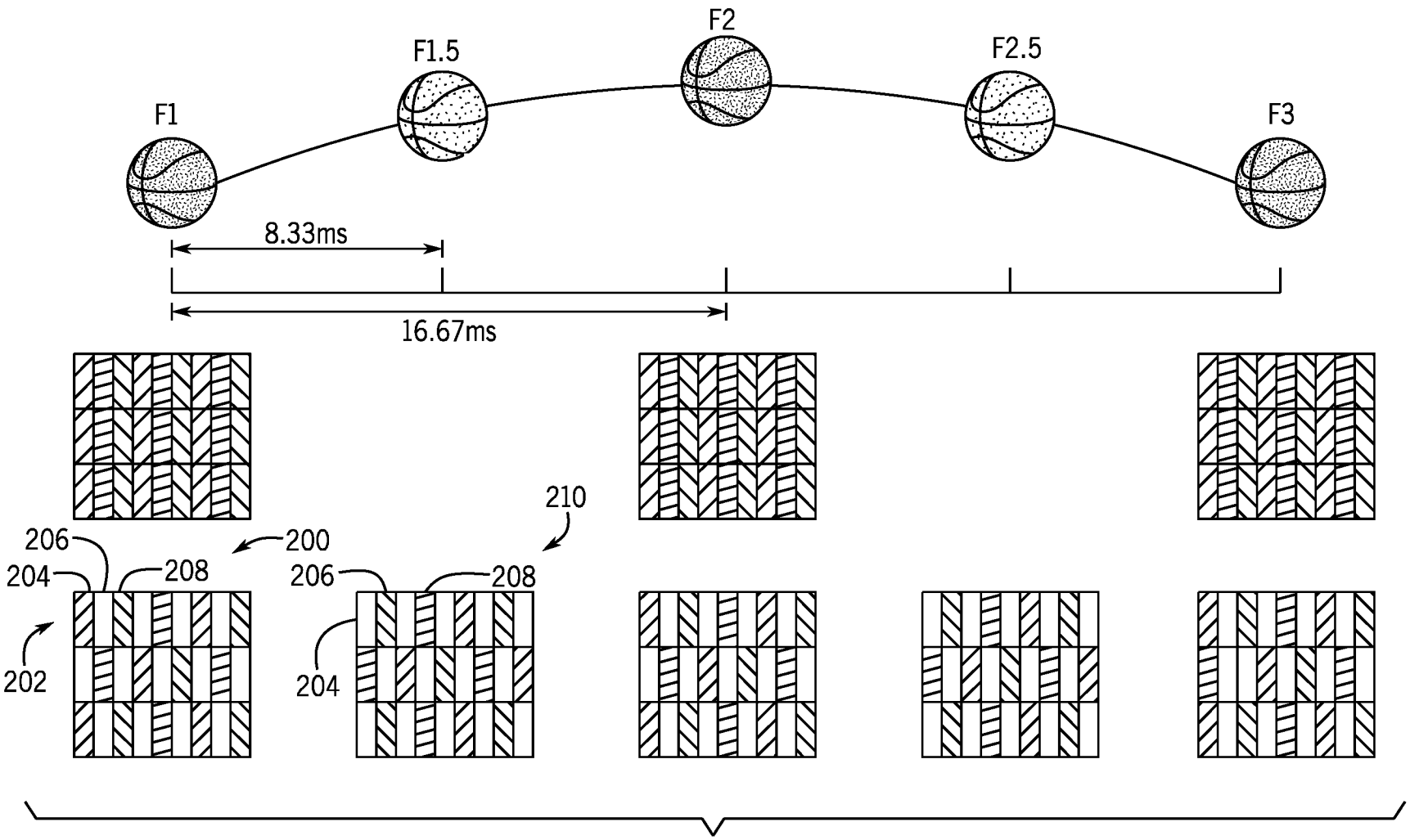
FIG. 14 depicts frames in which sub-pixels of the display are programmed in an interleaved manner, in accordance with an embodiment.

In the illustrated embodiment, the pixels include sub-pixels that, as described above, may correspond to different colors (e.g., red, blue, and green). While interleaving is shown as occurring at the pixel level, it should be noted that interleaving may be executed at the sub-pixel level. For example, FIG. 14 illustrates frames in which sub-pixels are interleaved. In frame 200, a pixel 202 includes sub-pixels 204, 206, and 208. In frame 200, sub-pixels 204 and 208 are utilized, while sub-pixel 206 is not utilized. However, in another frame 210, the sub-pixel 206 is rendered, and sub-pixels 204 and 208 are no longer utilized. In other words, at the end of the duration of the persistence of sub-pixels 204 and 208, sub-pixels 204 and 208 are no longer utilized, and sub-pixel 206 is rendered.

As with the embodiments in which the pixels are interlaced, utilizing interleaved pixels provides a reduction in visual artifacts. Additionally, because only a portion of the pixels of the display 18 are rendered at a given time, the processor core complex 12 may generate the additional frames (e.g., frame 210). While neither frame rate of the content nor the refresh rate of the display 18 is changed, the display 18 may appear to the human eye to be displaying content at a frame rate that is approximately double that of the actual frame rate and/or refresh rate. Additionally, because less processing power is utilized due to rendering a portion of the pixels, less power (e.g., power supplied by power source 29) may be used to process, render, and show content on the electronic device 10.

Figure 15:
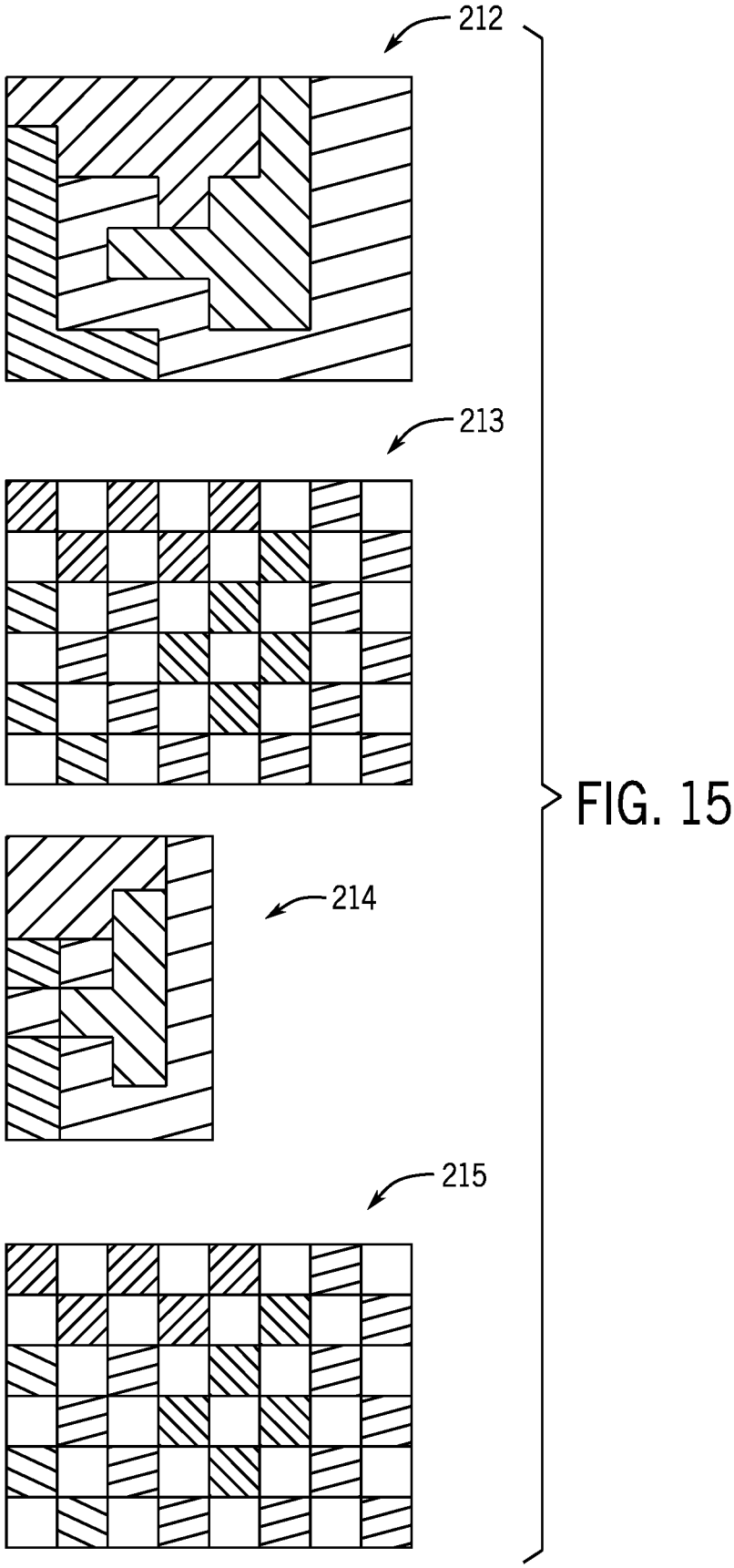
FIG. 15 illustrates data associated with the rendering of pixels of the display of FIG. 1, in accordance with an embodiment.

FIG. 15 provides a series of diagrams illustrating how pixels of the display 18 may be rendered when the pixels are to be utilized in an interleaved fashion. Diagram 212 illustrates a data output from the processor core complex 12 when interleaving is not utilized. In other words, the diagram 212 corresponds to usage of the display 18 in which all of the pixels of the display 18 are utilized. Diagram 213 illustrates a data output from the processor core complex 12 in which the pixels of the display 18 are to be utilized in an interleaved manner. For instance, the output data may be processed by the processor core complex 12 and/or image processing 30 to cause approximately half of the pixels of the display 18 to be used at a specific time. Because about half of the pixels are to be utilized, the amount of data in a frame buffer that is outputted to a display pipeline may be less than the amount of data typically transmitted when more than half of the pixels of the display 18 are utilized. For example, diagram 214 illustrates a frame buffer outputted from the processor core complex 12 or image processing 30 to a display pipeline. As illustrated, the diagram 214 is half of the size of diagram 213. Additionally, diagram 214 corresponds to the pixels of the display 18 that will be utilized when the data of diagram 213 is rendered. For instance, diagram 215 illustrates a remapping of pixels of the display 18 that may be conducted by processor core complex 12 or image processing 30. In other words, the data of diagram 215 may be generated from the data of diagram 214. In such a case, the amount of data associated with each frame passing through the display pipeline may be halved and processed twice as quickly compared to when data indicative of all of the pixels of the display 18 is used. However, as an alternative, data representative of both the used and unused pixels when interleaving is used may be included in the frame buffer data.

Figure 16:
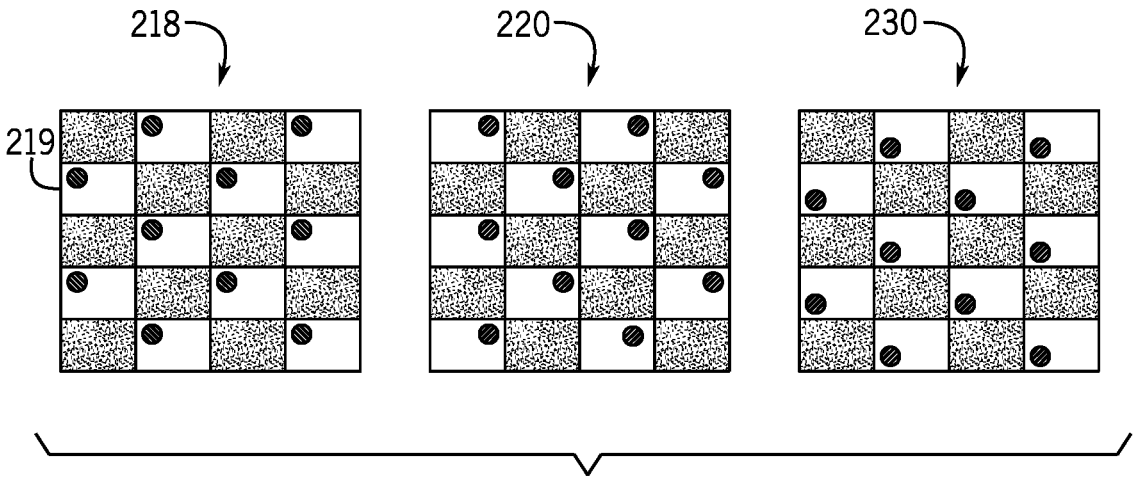
FIG. 16 illustrates frames in which various locations within pixels are rendered, in accordance with an embodiment.

In addition, it should be noted that when interleaving is utilized, the pixels may be rendered in a location other than the center of the pixels. FIG. 16 provides several examples of frames in which pixels are rendered. As illustrated, frame 218 includes pixels (e.g., pixel 219) that are rendered at the top left, frame 220 includes pixels that are rendered in the top right, and frame 230 includes pixels that are rendered in the bottom left. The processor core complex 12 and/or image processing 30 may determine which part of a pixel to render based on the content to be displayed.

Figure 17:
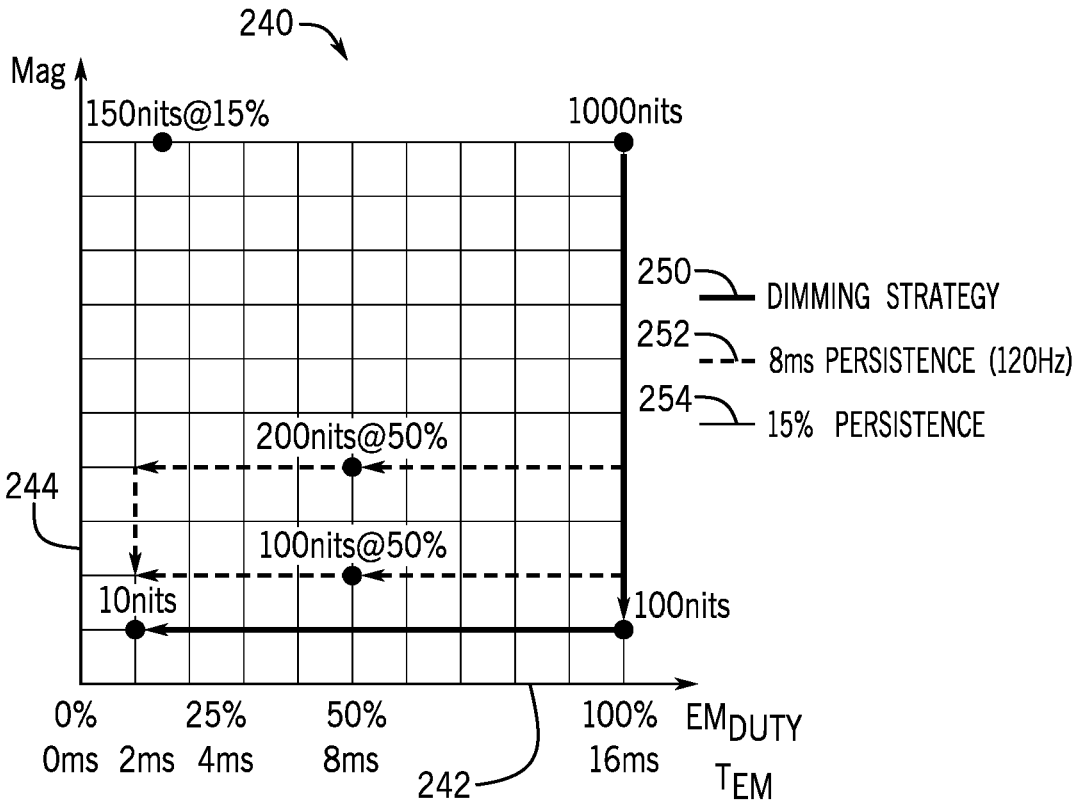
FIG. 17 is a graph of duty cycle versus analog signal during a change in brightness from pixels of the display of FIG. 1, in accordance with an embodiment.

FIG. 17 is a graph 240 of duty cycle versus analog signal during a change in brightness from pixels. Axis 242 corresponds to duty cycle, and axis 244 corresponds to the analog signal associated with the rendering of pixels of the display 18. The axis 242 include percentages referring to a duty cycle of on-time to off-time of each pixel (which also corresponds to the percentages of the amount of pixels of the display 18 that are utilized at any time). The axis 242 also includes specific values, in milliseconds, corresponding to the amounts of time that relate to the duty cycle percentages. It should be noted that these time values correspond to a refresh rate of 60 hertz.

The graph 240 includes data 250 that corresponds to a transition from 1000 nits to 100 nits to 10 nits of brightness for pixels of the display 18. The data 250 is associated cases in which neither interlacing nor interleaving is utilized. As shown, to during a transition from 1000 nits to 100 nits, all of the pixels of the display 18 are used at any given time (e.g., a duty cycle of 100%), and there is a decrease in analog signal corresponding to a decrease in brightness. Additionally, in the transition from 100 nits to 10 nits, the analog signal is maintained, but fewer pixels are utilized. As discussed above, such a transition (i.e., a transition from 1000 nits to 10 nits), may result in visual artifacts due to higher persistence at higher brightness levels.

Data 252 pertains to the embodiment illustrated in FIG. 10. As shown, in FIG. 10 and the graph 240 of FIG. 17, approximately half of the pixels of the display 18 are utilized at a given time, and the pixels have a persistence that is shorter than the amount of time associated with the refresh rate. For example, at a refresh rate of 60 hertz, which is associated with approximately 16.6 milliseconds (i.e., one second divided by sixty), the pixels may have a persistence of approximately 8.3 milliseconds. As shown in the graph, brightness of 200 nits is achieved at one level of analog signal, while a brightness of 100 nits is achieved while maintaining the same duty cycle and decreasing the analog signal. Similarly, the brightness may also be modified by lowering the persistence of the pixels.

Data 252 pertains to an embodiment similar to the embodiment illustrated in FIG. 11. As shown in graph 240, a brightness of 150 nits may achieved while utilizing 15% of the pixels of the display 18. In such a case, the persistence of the pixels is also approximately equal to 15% of the amount of time associated with the refresh rate. As described above, the amount of time associated with the refresh rate is approximately 16.6 milliseconds when the refresh rate is 60 hertz. As shown in the graph 240, the persistence of the pixels when the embodiment represented by the data 252 is utilized is approximately 2.5 milliseconds, which is approximately 15% of 16.6 milliseconds.

Figure 19:
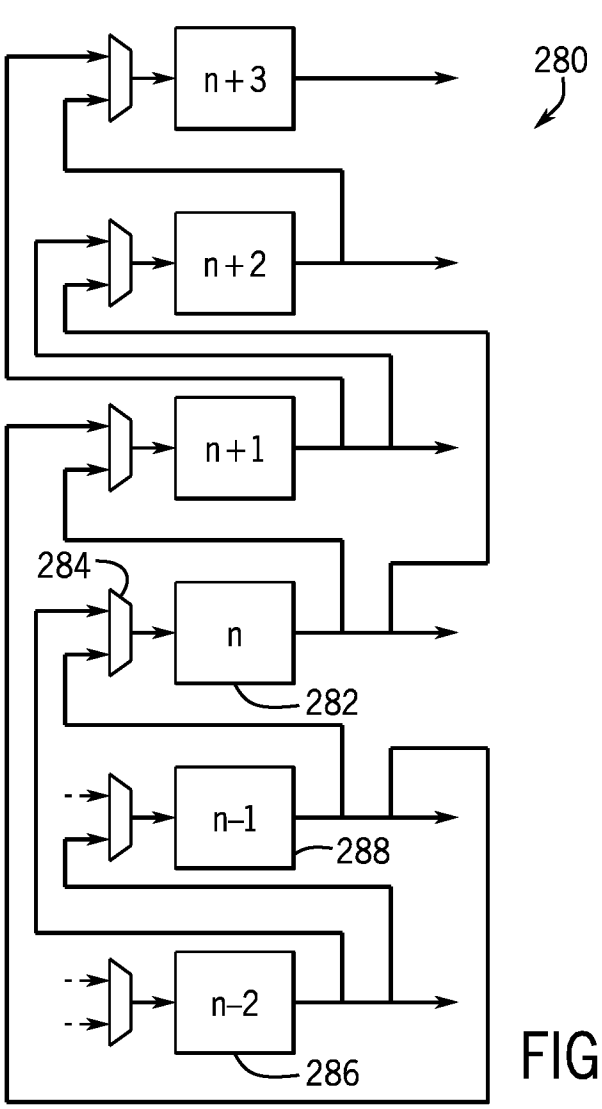
FIG. 19 is another circuit diagram for gate-driving circuitry to implement interlacing and/or interleaving of pixels of the display of FIG. 1, in accordance with an embodiment.
Figure 18:
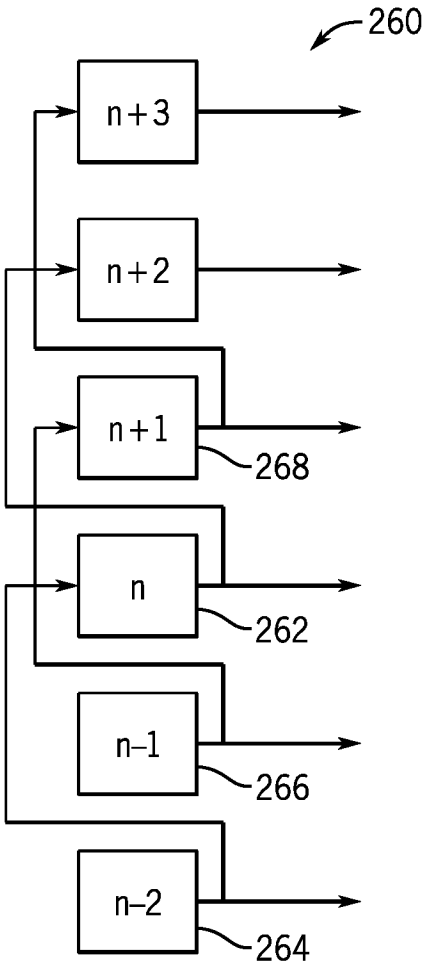
FIG. 18 is circuit diagram for gate-driving circuitry to implement interlacing and/or interleaving of pixels of the display of FIG. 1, in accordance with an embodiment.

FIG. 18 and FIG. 19 provide circuit diagrams for gate-driving circuitry to activate rows of pixels of the display 18. Implementation 260 of FIG. 18 may be used to render pixels in an interlaced or interleaved manner. The implementation 260 provides for alternating rows of pixels to be rendered. For instance, row 262 and row 264 are rendered at the same time (e.g., during the same phase). Similarly, row 266 may be rendered at the same time as row 268.

An implementation 280 of FIG. 19 allows for both non-interlaced/non-interleaved and interlaced/interleaved operation using multiplexing. For example, in implementation 280, a row 282 of pixels of the display 18 may be rendered based on signals relating to previous rows of pixels received by a multiplexer 284. More specifically, the multiplexer 284 may receive signals associated with a row 286 and another row 288. The multiplexer 284 may select signals associated with one of the rows 286 or 288, and the row 282 may be rendered based on the selected signals. Implementation 270 allows for actively switching between how pixels are rendered. For example, the multiplexer 284 and other multiplexers be controlled to select signals associated with two rows before a row of pixels to be generated under certain conditions (e.g., interleaved/interlaced operation), while under other conditions, the multiplexers may be controlled to select signals associated with a row of pixels immediately before the row to be generated (e.g., non-interleaved/non-interlaced operation). For example, multiplexers such as those illustrated in FIG. 19 may be included in the processor core complex 12, and the processor core complex 12 may determine when to utilize interleaving or interlacing. For instance, interleaving and interlacing may be utilized based on screen brightness, detected movement of the electronic device 10, ambient light, and other factors.

Figure 20:
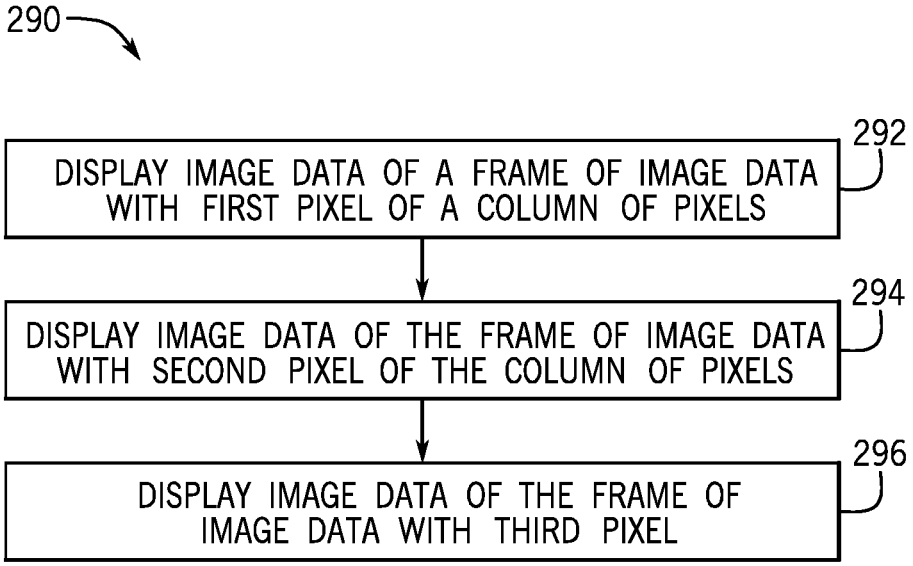
FIG. 20 is a flowchart of a method for displaying image data on the display of FIG. 1, in accordance with an embodiment.

FIG. 20 is a flowchart of a method 290 for displaying image data that may be performed by the electronic device 10. More specifically, the display 18 may perform the method 290 based on image data 92 generated by the processor core complex 12. Moreover, the method 290 may be performed in order to utilize pixels of the display 18 as shown in FIGS. 10-14. Additionally, the steps of the method 290 discussed below may be performed in an order that differs from the order in which the steps are discussed.

At block 292, image data associated with a frame of content may be displayed with a first pixel of the display 18. More specifically, the pixel may be located in a column of pixels of the display 18. Additionally, the image data may be displayed with the first pixel at a first time and for a first duration of time. The first duration of time may be less than the duration of time of the frame of content. For example, if the frame of content has a duration of 16.6 milliseconds, the first pixel may display the image data for an amount of time that is shorter than 16.6 milliseconds, such as approximately 8.3 milliseconds or 4.17 milliseconds.

At block 294, image data associated with the frame of content may be displayed by a second pixel of the display at a second time for a second duration of time. For instance, the second pixel may be used to display the image data at a time that starts after the first duration of time has expired. Also, the second duration of time may be shorter than the duration of the frame of content. For instance, the second duration may be equal to the first duration. More specifically, in some cases, the pixels of the display 18 may share a pixel emission period during which pixels are used to display content on the display 18, and first and second durations may be equal to the pixel emission period. Furthermore, the pixel emission period may correspond to a fraction of an amount of time associated with the refresh rate of the display 18. For instance, in one embodiment, the display 18 may have a refresh rate of 60 hertz, meaning that pixels be updated every approximately 16.6 milliseconds. The pixel emission period may be one-half (i.e., approximately 8.3 milliseconds), one-quarter (i.e., approximately 4.17 milliseconds), or another fraction of time of 16.6 milliseconds. Moreover, the second pixel may be in the same column of pixels as the first pixel. In some embodiments, the second pixel may be a pixel that is adjacent to the first pixel. In other embodiments, the second pixel may be separated from the first pixel by several other pixels. For example, the first and second pixels may be separated by one, two, three, four, five, six, seven, eight, nine, ten, or more pixels.

At block 296, image data associated with the frame of content may be display by a third pixel of the display. In some embodiments, the third pixel may be displayed at the same time as the first or second pixel for the same duration of time as the first or second pixel. Yet, in other embodiments, the third pixel may be shown at a third time that is different from the first and second times. Additionally, the third pixel may be in the same column of pixels as the first and second pixels. However, in other embodiments, the third pixel may be located in a row of pixels that is shared with the first pixel or the second pixel. Indeed, in some cases, the third pixel may be adjacent to the first pixel of the second pixel.

The method 290 may also include additional steps. For example, the method 290 may also include displaying image data of the frame with a fourth pixel. The fourth pixel may be used to display the image data at the same time as the first or second pixel in some embodiments, while in other embodiments, the image data may be shown with the fourth pixel at a time that is different than the first, second, and third pixels. Additionally, the fourth pixel may be located in the same row of pixels as the first or second pixel, and the forth pixel may be display for a duration of time that is equal to the duration of time associated with the first pixel, second pixel, or third pixel.

Additionally, steps of the method 290 may be repeated. For example, the processor core complex 12 may generate image data 92 associated with other frames of content and cause the display 18 to show the other frames of content in the manner described above. That is, the method 290 may be performed to show several frames of content.

While many examples in the present disclosure discuss refresh rates of 60 hertz, frame rates of 60 fps, and timings associated with these refresh rates and frame rates, it should be understood that these are provided solely as examples. In practice, the techniques described herein may be utilized for displays having refresh rates that differ from 60 hertz. Moreover, the techniques described herein may also be used on content that has a frame rate that is less than or greater than 60 fps.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An electronic device comprising:

processing circuitry configured to generate a frame of image data that has a frame duration; and an electronic display comprising a plurality of pixels, wherein each of the plurality of pixels is configured to display image data from the frame of image data for a pixel emission period that is less than the frame duration, wherein a first pixel of a column of pixels of the plurality of pixels is configured to begin displaying the image data from the frame of image data at a first time for a first duration of time equal to the pixel emission period, wherein a second pixel of the column of pixels that is adjacent to the first pixel is configured to begin displaying the image data from the frame of image data at a second time for a second duration of time equal to the pixel emission period, wherein the second time begins after the first duration of time has ended.

2. The electronic device of claim 1, wherein the plurality of pixels comprises a third pixel of the column of pixels, wherein the third pixel is configured to begin displaying the image data from the frame of image data at the first time for a third duration of time equal to the pixel emission period.

3. The electronic device of claim 2, wherein the plurality of pixels comprises a fourth pixel, wherein the first and fourth pixels are positioned on a row of pixels of the plurality of pixels, wherein the fourth pixel is configured to begin displaying the image data from the frame of image data at the second time for a fourth duration of time equal to the pixel emission period.

4. The electronic device of claim 1, wherein the first pixel corresponds to a first sub-pixel, wherein the second pixel corresponds to a second sub-pixel.

5. The electronic device of claim 1, wherein the pixel emission period is less than a duration of time associated with a refresh rate of the electronic display.

6. The electronic device of claim 5, wherein the pixel emission period is one-half or one-quarter of the duration of time associated with the refresh rate of the electronic display.

7. An electronic device comprising:

processing circuitry configured to generate a frame of image data that has a frame duration; and an electronic display configured to display the frame of image data, wherein the electronic display comprises a plurality of pixels, wherein each of the plurality of pixels is configured to display image data from the frame of image data for a pixel emission period that is less than the frame duration, wherein the plurality of pixels comprises a plurality of rows of pixels, wherein the electronic display is configured to:

at a first time, begin displaying the image data from the frame of image data on a first row of the plurality of rows of pixels for a first duration of time equal to the pixel emission period; and at a second time beginning after the first duration of time has ended, begin displaying the image data from the frame of image data on a second row of the plurality of rows of pixels for a second duration of time equal to the pixel emission period.

8. The electronic device of claim 7, wherein the first and second rows of pixels are separated by eight or fewer than eight rows of pixels.

9. The electronic device of claim 7, wherein the first and second rows of pixels are adjacent to one another.

10. The electronic device of claim 7, wherein the pixel emission period is half or less than half of the frame duration.

11. The electronic device of claim 7, wherein the pixel emission period is one quarter or less than one quarter of the frame duration.

12. The electronic device of claim 11, wherein the first and second rows of pixels are adjacent to one another.

13. The electronic device of claim 7, wherein the electronic display is configured to, at a third time, begin displaying the image data from the frame of image data on a third row of the plurality of rows of pixels for a third duration of time equal to the pixel emission period, wherein the third time corresponds to a time between the first time and the second time.

14. The electronic device of claim 13, wherein the second row of pixels is adjacent to both of the first and third rows of pixels.

15. The electronic device of claim 7, wherein the plurality of rows of pixels comprises a third and fourth row of pixels, wherein the second row of pixels is adjacent to the first and third rows of pixels, wherein the third row of pixels is adjacent to the fourth row of pixels, wherein half or one quarter of a total number of pixels of the first, second, third, and fourth rows of pixels are configured to display image data from the frame of image data at a third time.

16. A method, comprising:

at a first time, displaying image data of a frame of image data with a first pixel of a column of pixels of a plurality of columns of pixels of an electronic display for a first duration of time, and at a second time beginning after the first duration of time has ended, displaying the image data of the frame of image data with a second pixel of the column of pixels for a second duration of time, wherein the second pixel is adjacent to the first pixel.

17. The method of claim 16, wherein a sum of the first and second durations of time is equal to an amount of time corresponding to a refresh rate of the electronic display.

18. The method of claim 16, comprising, at the second time, displaying the image data of the frame of image data with a third pixel, wherein the first and third pixels are positioned adjacent to one another in a row of pixels of the electronic display.

19. The method of claim 16, comprising, at a third time, displaying the image data of the frame of image data with a third pixel of the column of pixels for a third duration of time, wherein the third time corresponds to a time between the first and second times.

20. The method of claim 16, wherein the first and second durations of time are less than an entire duration of the frame.

* * * * *